US005193284A

United States Patent [19]

Lin

[11] Patent Number: 5,193,284

[45] Date of Patent: Mar. 16, 1993

[54] MULTI-PURPOSE DRAWING RULER

[76] Inventor: Chin-Hsiu Lin, 2F, No. 7, Alley 4, Lane 100, Ming li St., Chung ho City, Taipei Hsien, Taiwan

[21] Appl. No.: 856,731

[22] Filed: Mar. 24, 1992

[51] Int. Cl.[5] ..... B43L 13/02

[52] U.S. Cl. ..... 33/449; 33/27.03

[58] Field of Search ..... 33/449, 448, 27.05, 33/27.03, 27.01, 26

[56] References Cited

U.S. PATENT DOCUMENTS 35,812 7/1962 Dow et al. ..... 33/449

5,050,309 9/1991 Wang ..... 33/449

*Primary Examiner*—Harry N. Haroian

*Attorney, Agent, or Firm*—Bacon & Thomas

[57] ABSTRACT

A multi-purpose drawing ruler comprising a ruler body, a direction wheel shaft assembly, two brake assemblies, two reset shafts and two retainers, in which the ruler body is in the form of a straight ruler with markings of length along an edge, a plurality of holes at appropriate positions along the markings for passing through of a drawing pen, a pivot at the right end of the markings and another pivot at the left end of the markings, a rail at the front end for attachment of two retainers, a slot in the middle of the ruler body for installation of the direction wheel shaft assembly, a pair of rail at each end of the slot for installation of a brake assembly, an elliptical hole at each end of the slot and a reset indicator on its top so that after placing of the direction wheel shaft assembly in the slot, each reset shaft is fixed to a screw hole at the direction wheel shaft after passing through the elliptical hole and the hole at the brake assembly is disclosed.

5 Claims, 13 Drawing Sheets

MULTI-PURPOSE DRAWING RULER

BACKGROUND OF THE INVENTION

The present invention related to a drawing tool, particularly a multi-purpose drawing ruler for drawing of different graphs.

Conventionally each drawing tool, such as straight ruler, triangle, T-square, compass or the like can be used to draw a certain graph. For drawing of a geological graph or a combination of different graphs, a number of different drawing tools must be used, and hence it is very inconvenient.

SUMMARY OF THE INVENTION

In view of the above defects, the multi-purpose drawing ruler of the present invention combines combined the functions of different drawing tools for drawing of different graphs. It can also be attached with different drawing templates, and it has the functions of braking, resetting, etc. to eliminate the defects of the conventional drawing tools.

BRIEF DESCRIPTION OF THE DRAWINGS

These and other objects and features of the invention will become more apparent from the following description taken in connection with the accompanying drawings wherein.

DETAILED DESCRIPTION OF THE PREFERRED EMBODIMENT

Figure 1:
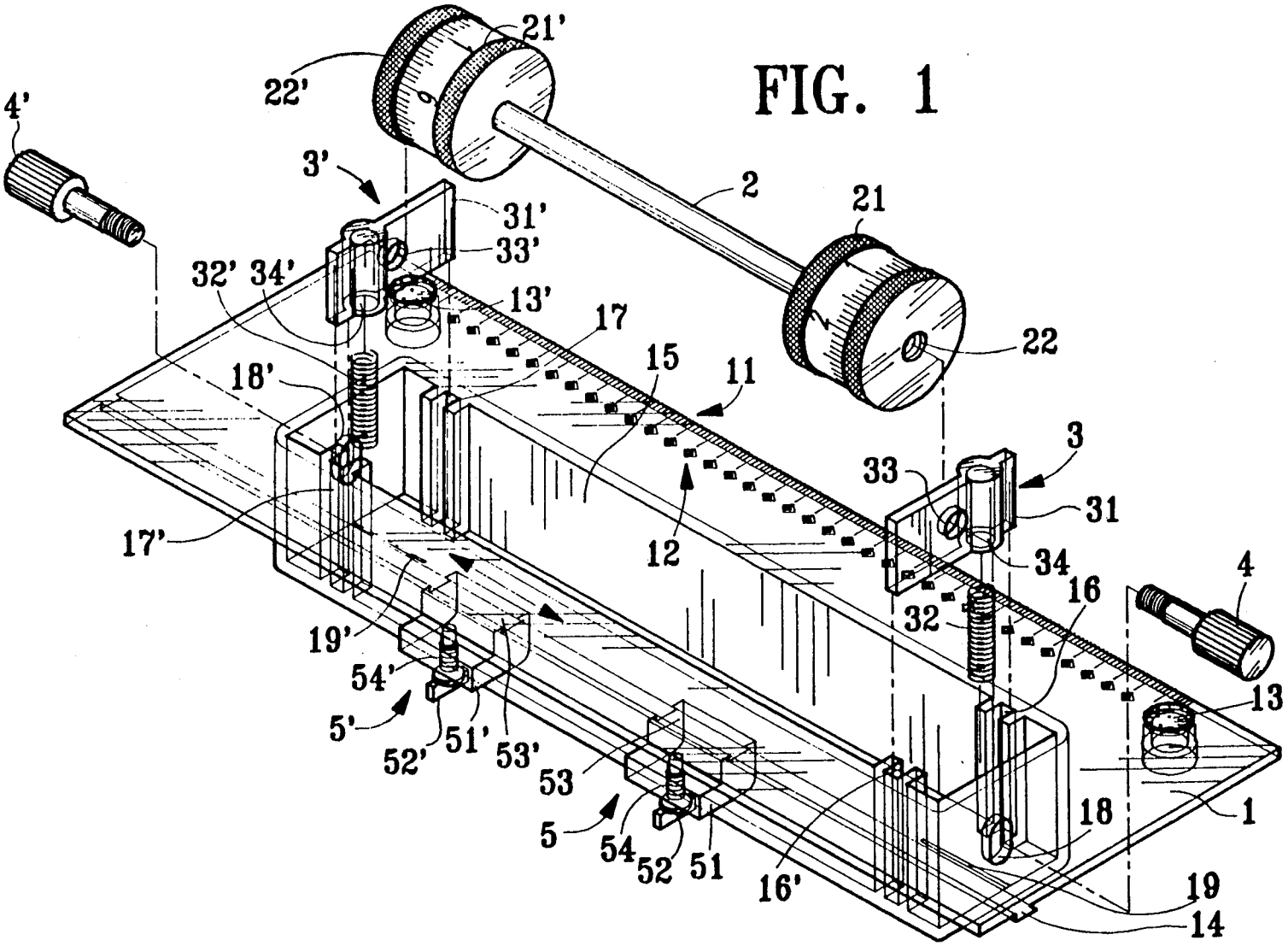
FIG. 1 is a perspective and fragmental view of a multi-purpose drawing ruler according to the present invention.
Figure 2:
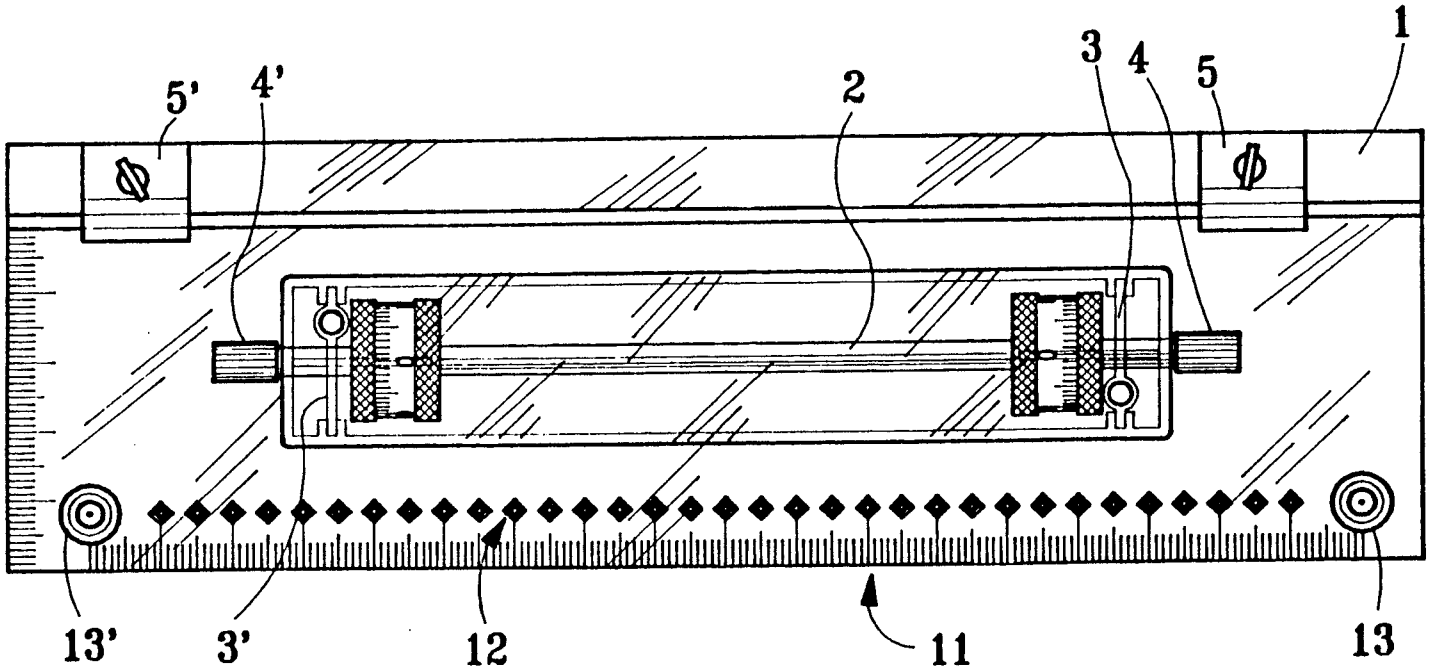
FIG. 2 is a plan view of the multi-purpose drawing ruler according to the present invention.

With initial reference to FIG. 1 which depicts a perspective view of a multi-purpose drawing ruler according to the present invention, the multi-purpose drawing ruler comprises mainly a ruler body (1), a direction wheel shaft assembly (2), two brake assemblies (3 and 3'), two reset shafts (4 and 4'), and a pair of retainers (5 and 5'). The ruler body (1) is preferably a rectangular board having a straight edge with markings (11) along its length. Adjacent the markings a plurality of through holes (12) are made at appropriate positions for passing through of drawing pen. A knob (13) is designed on the left end of the markings (11) and another knob (13') at its right end. A rail (14) is placed along the front edge of the ruler body (1), while a slot (15) for placing of the direction wheel shaft assembly (2) is formed in the middle. A pair of rails (16 and 16') and an elliptic hole (18) are designed at a side of the slot (15) while another pair of rails (17 and 17') and another elliptic hole (18') are designed at the opposite side. On the top of each of the opposite sides of the slot (15), there is a reset indicator (19 or 19'). Each of the brake assemblies (3 or 3') is composed of a sliding element (31 or 31') and a spring (32 or 32'). There is a round hole (33 or 33') in the middle of each sliding element (31 or 31'), a hole (34 or 34') at a side of each sliding element (31 or 31') for placing of a spring (32 or 32'). The sliding elements (31 and 31') are fitted to the respective rails (16 and 16'or 17 and 17'respectively). There is a roller (21 or 21') at each end of the direction wheel shaft assembly (2). Around each roller (21 or 21') there is a scale. A screw hole (22 or 22') is made at the center of each roller (21 or 21') and the wheel shaft assembly (2) is adapted to be received in the slot (15). Each of the reset shafts (4 or 4') passes through an elliptic hole (18 or 18') and a hole (33 or 33') and then fixed in a screw hole (22 or 22') along the axis of wheel shaft assembly (2). Each of the retainers (5 or 5') comprises a retainer body (51 or 51') and a butterfly screw (52 or 52'). A groove (53 or 53') is formed on the bottom of each retainer body (51 or 51') to the rail (14) on the ruler body (1). Each retainer body (51 or 51') has a screw hole (54 or 54') at its front end for fitting of a butterfly screw (52 or 52') to form a multi-purpose drawing ruler as shown in FIG. 2.

Figure 3A:
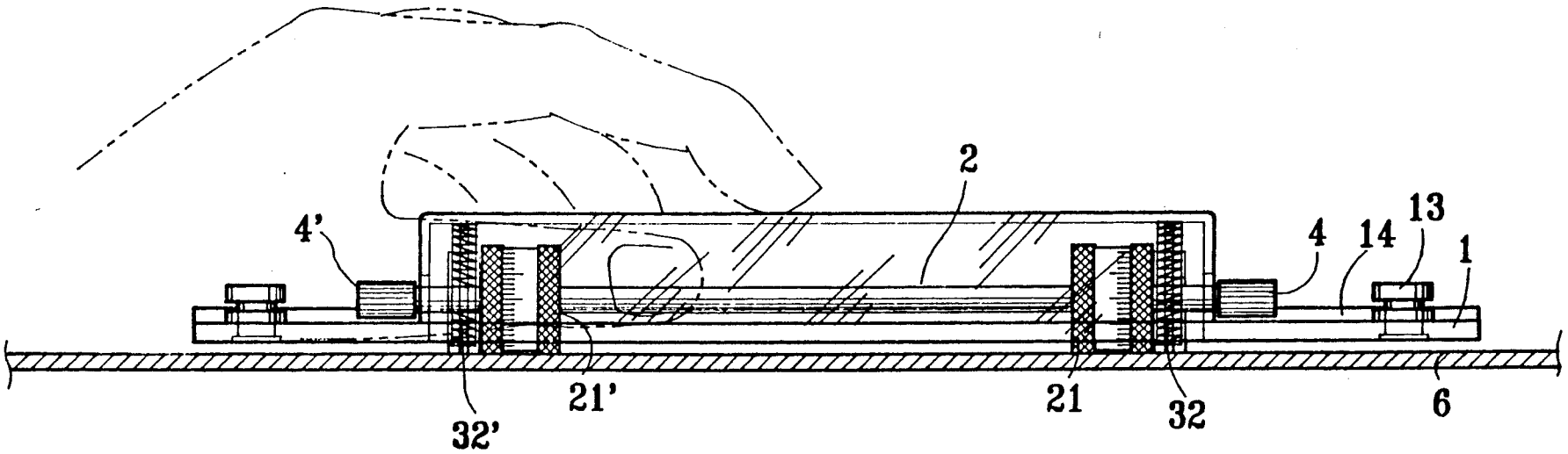
FIGS. 3A and 3B illustrate sliding and braking of the multi-purpose drawing ruler according to the present invention.
Figure 3B:
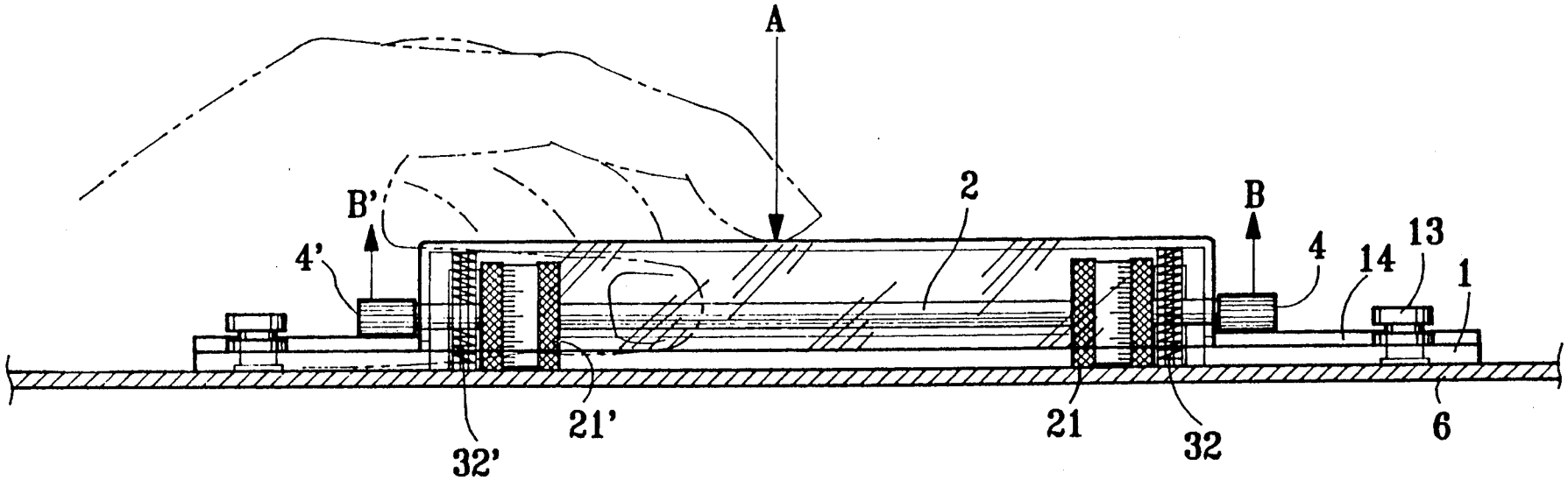
Figure 4:
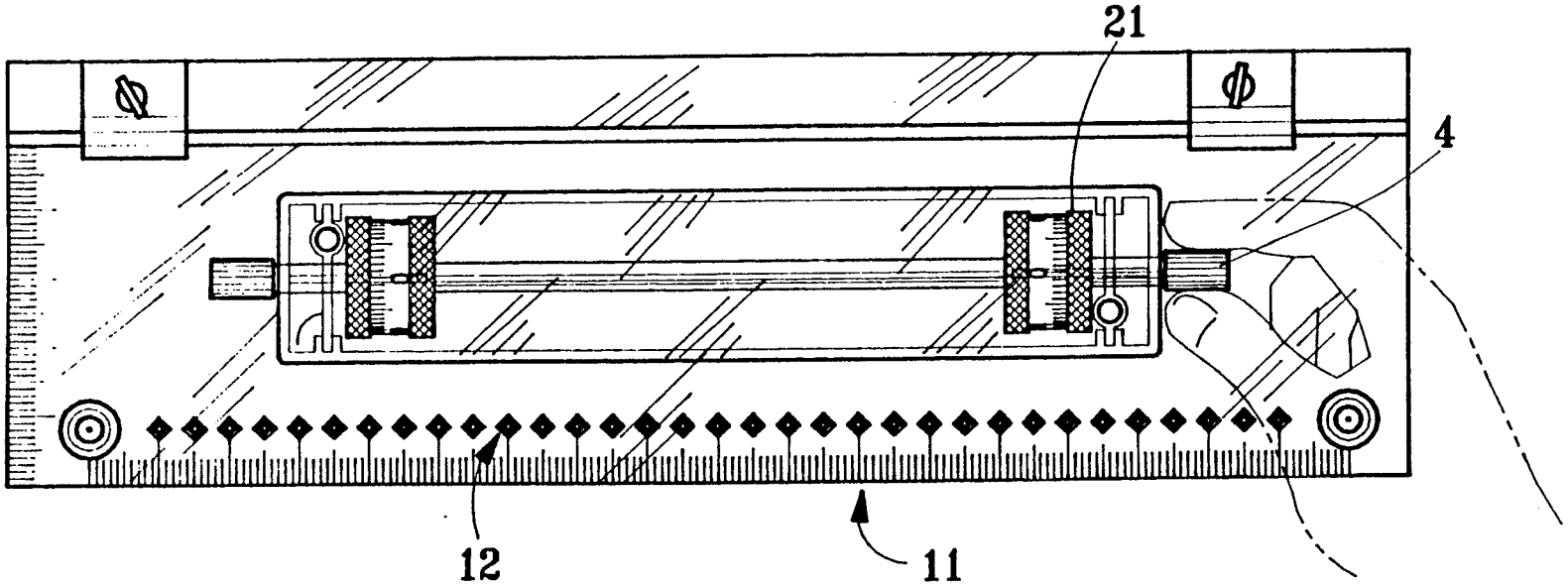
FIG. 4 illustrates resetting of the multi-purpose drawing ruler according to the present invention.

Reference will now be made to FIGS. 3A and 3B in discussing the sliding and braking of the drawing ruler according to the present invention. As shown in FIG. 3A, when the ruler body (1) is pressed lightly with a pressure smaller than the tension exerted by the springs (32 and 32') of the brake assemblies (3 and 3'), the rollers (21 and 21') of the direction wheel shaft assembly (2) are exposed outside the ruler body (1), and hence the ruler body (1) does not contact with a drawing paper (6) beneath it. In this way, the ruler body (1) can be slid linearly in any direction on the drawing paper (6). To fix the ruler body (1) on the drawing paper (6), a greater force A (see FIG. 3B) is applied to the ruler body (1) so that the pressure applied is greater than the tension exerted by the springs (32 and 32') of the brake assembly (3) so that the rollers (21 and 21') are retracted into the ruler body (1) consequently, the ruler body (1) comes into contact with the drawing paper (6) and is retained thereon to facilitate drawing on the paper as shown in FIG. 3B, without worrying about unwanted sliding of the ruler body (1). To reset the direction wheel shaft assembly (2), the reset shaft (4) is turned till the graduation 0 on the roller (21) is aligned with the reset indicator (19) on the ruler body (1), as shown in FIG. 4.

Figure 5A:
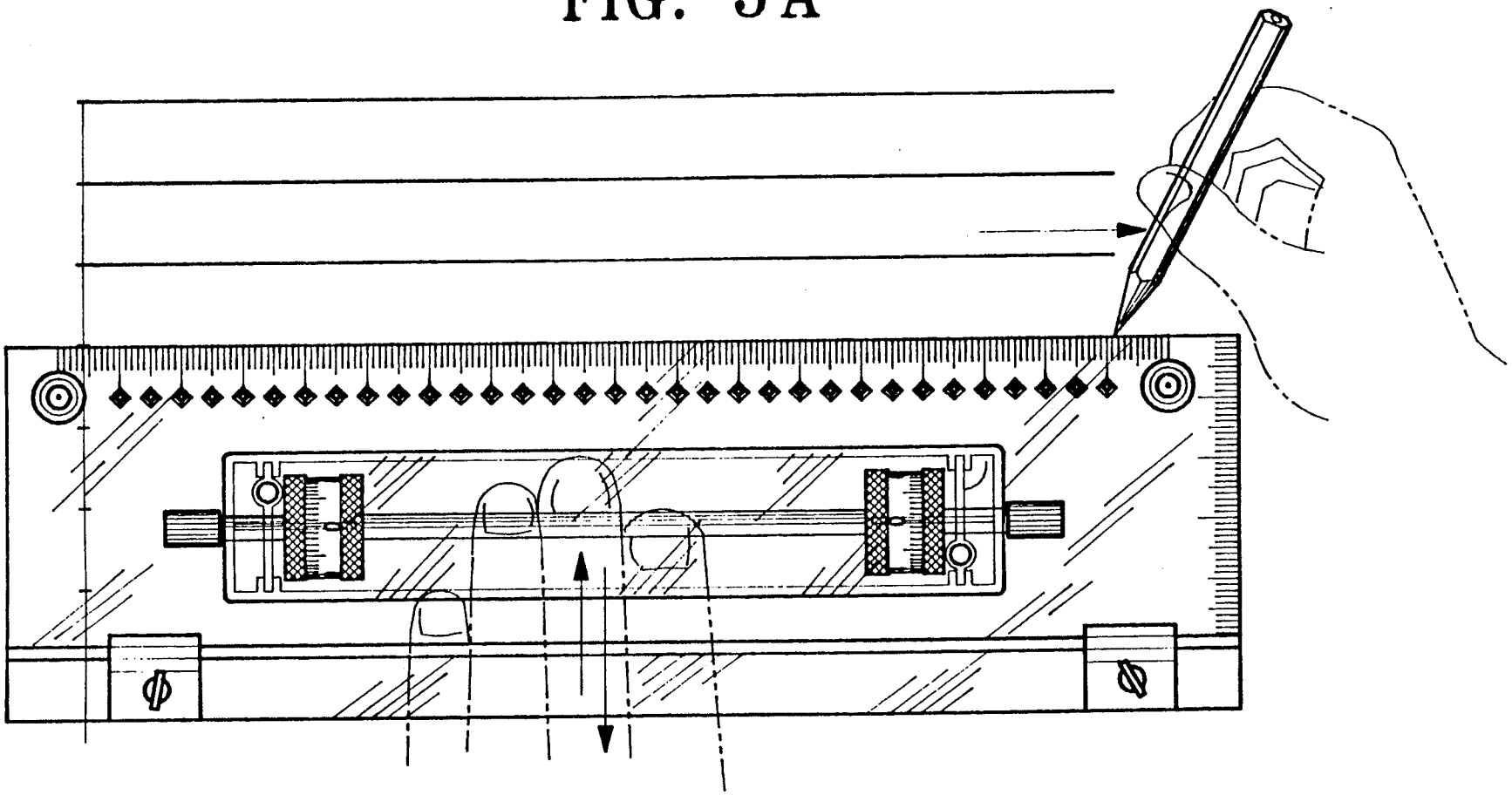
FIG. 5A through 5C illustrates drawing of different graphs with the multi-purpose drawing ruler according to the present invention.
Figure 5B:
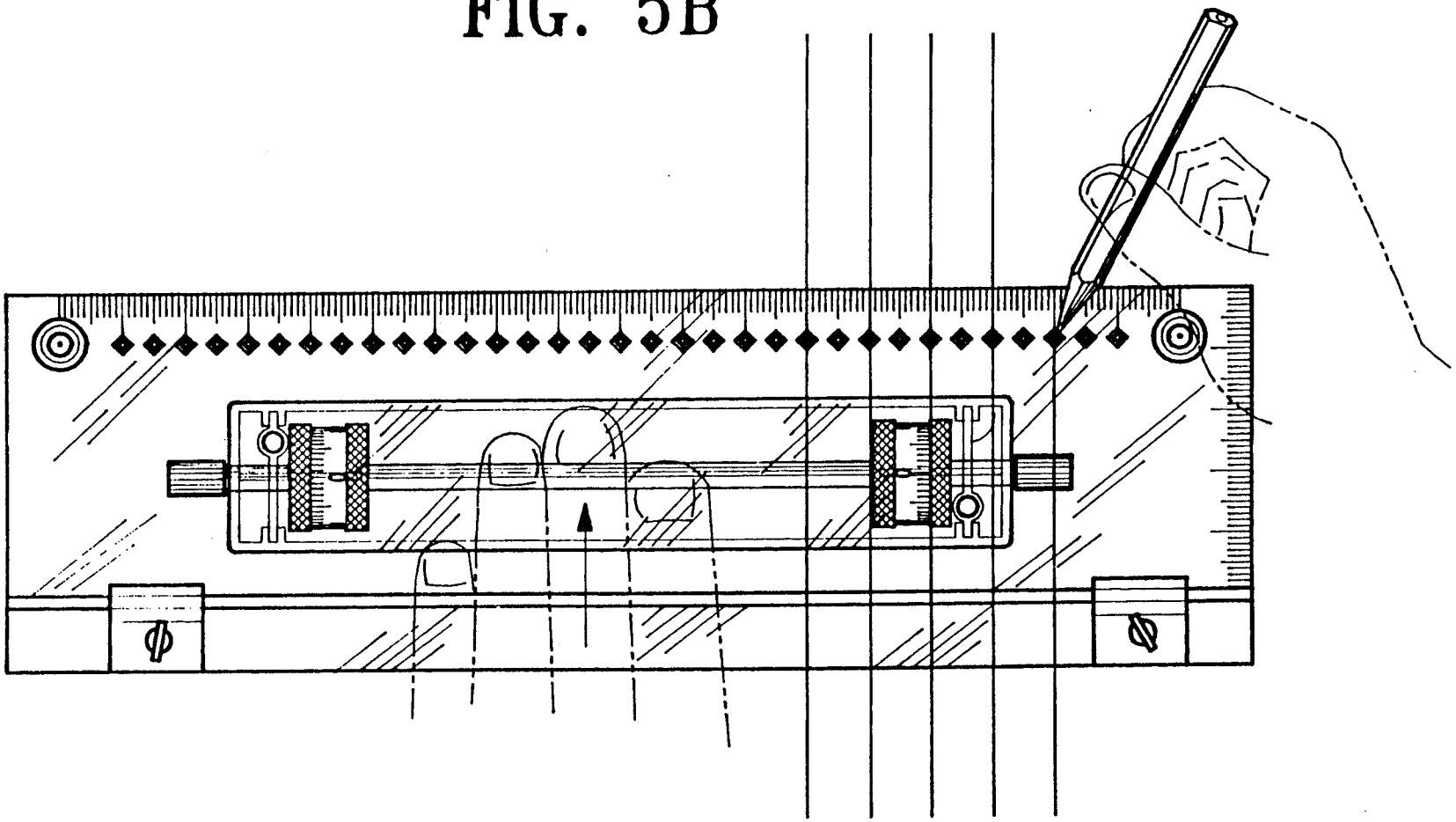
Figure 5C:
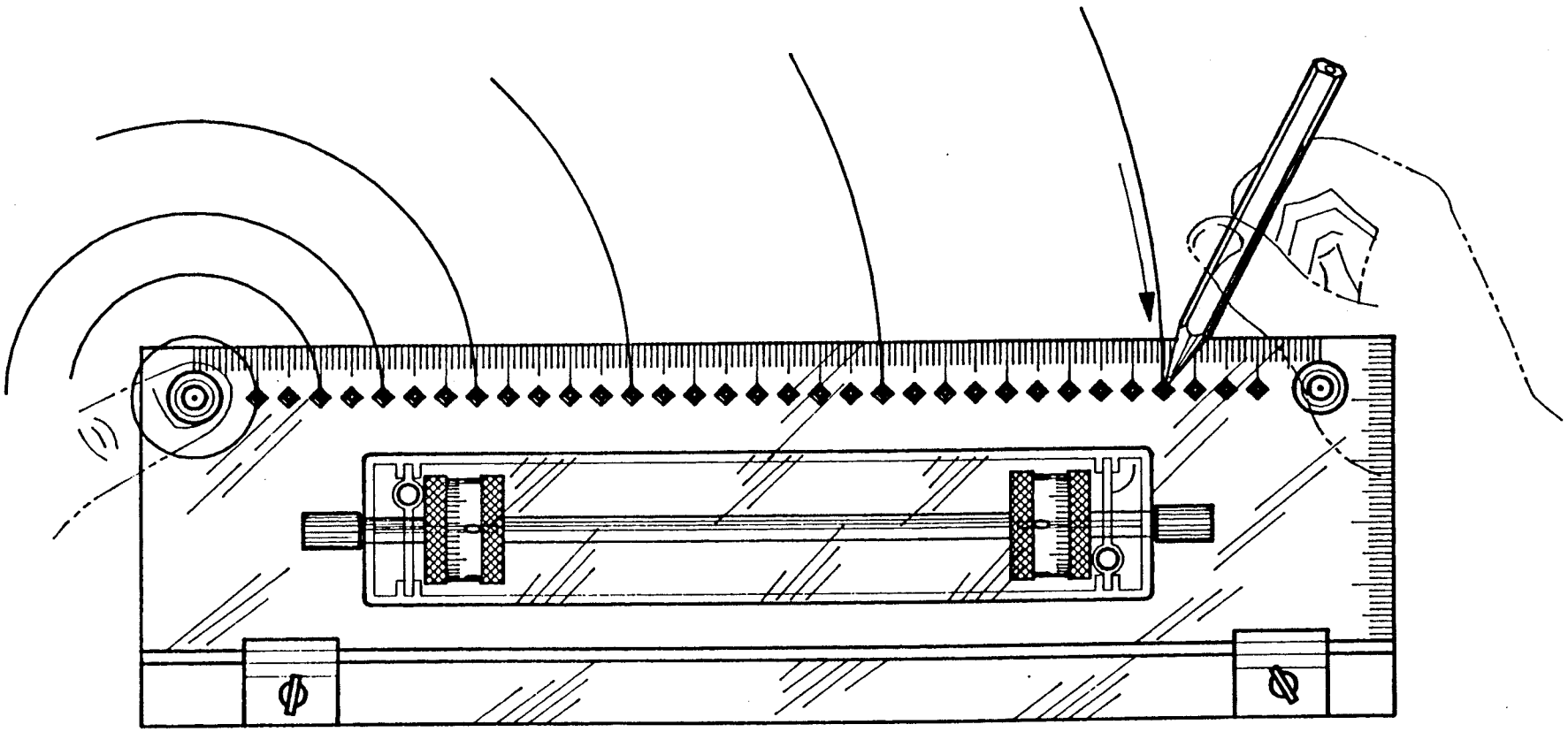
Figure 6:
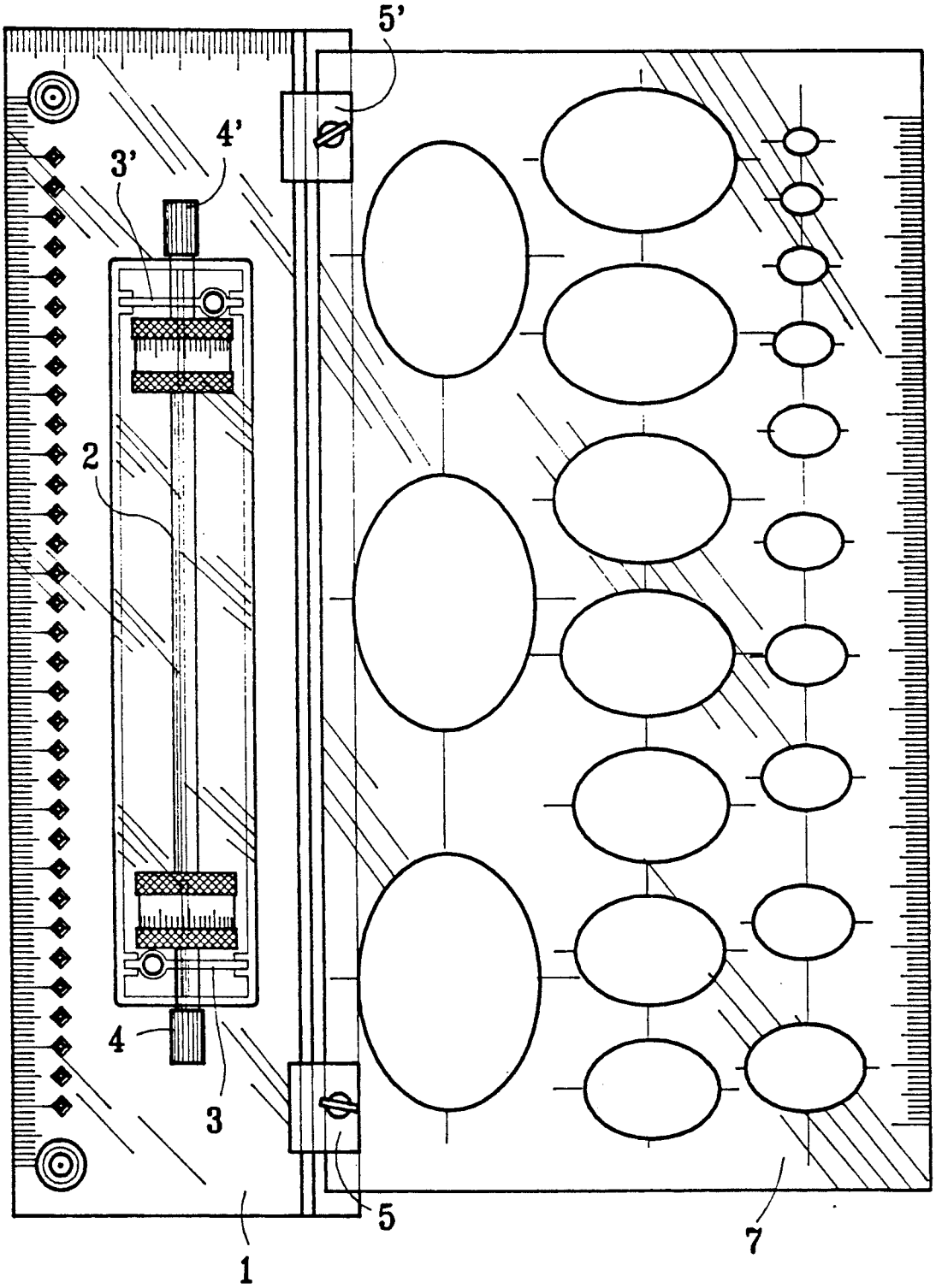
FIG. 6 illustrates an attachment of a drawing template to the multi-purpose drawing ruler according to the present invention.
Figure 7:
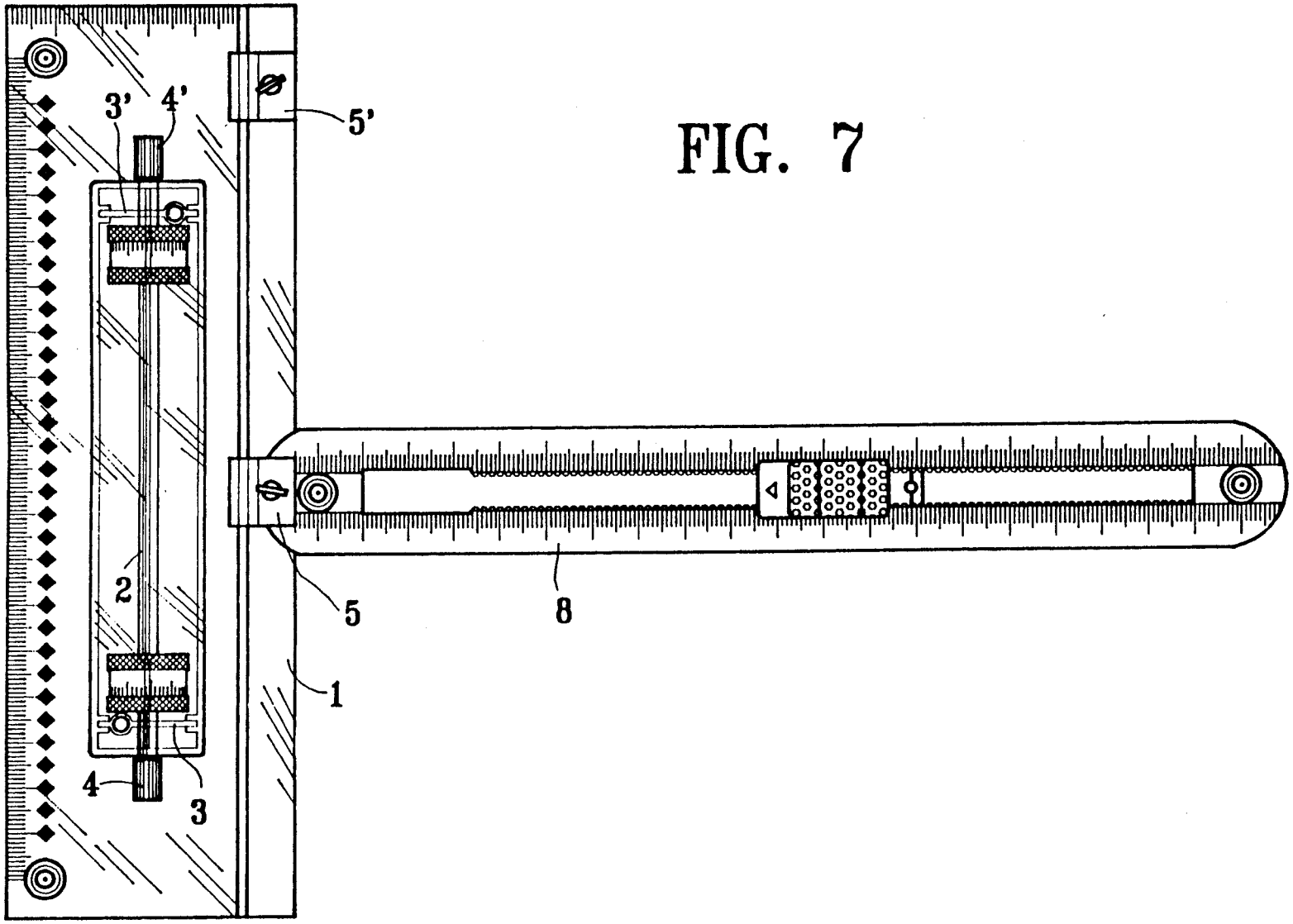
FIG. 7 illustrates an attachment of a compass to the multi-purpose drawing ruler according to the present invention.

Reference will now be made to FIGS. 5A through 5C in describing the drawing of different graphs with the drawing ruler according to the present invention. The drawing ruler can be used to draw horizontal lines in different intervals as shown in FIG. 5A, and vertical lines in different intervals as shown in FIG. 5B, or a combination of horizontal lines and vertical lines to draw forms of different formats. As shown in FIG. 5C, the drawing ruler can be used to draw circles or arcs of different diameters. As shown in FIG. 6, any drawing template can be attached to the drawing ruler according to the present invention. A desired drawing template (7) is attached to the drawing ruler by fixing it to the retainers (5 and 5'), and then by sliding of the drawing ruler different graphs can be drawn. Furthermore, the drawing ruler can be attached with any compass to draw a straight line or a right angle as shown in FIG. 7. The above description refers to only a few examples of what the drawing ruler can be used to draw. It is not possible to describe all the types of graphs which it can be used to draw because the actual number of graphs is infinite.

Figure 8:
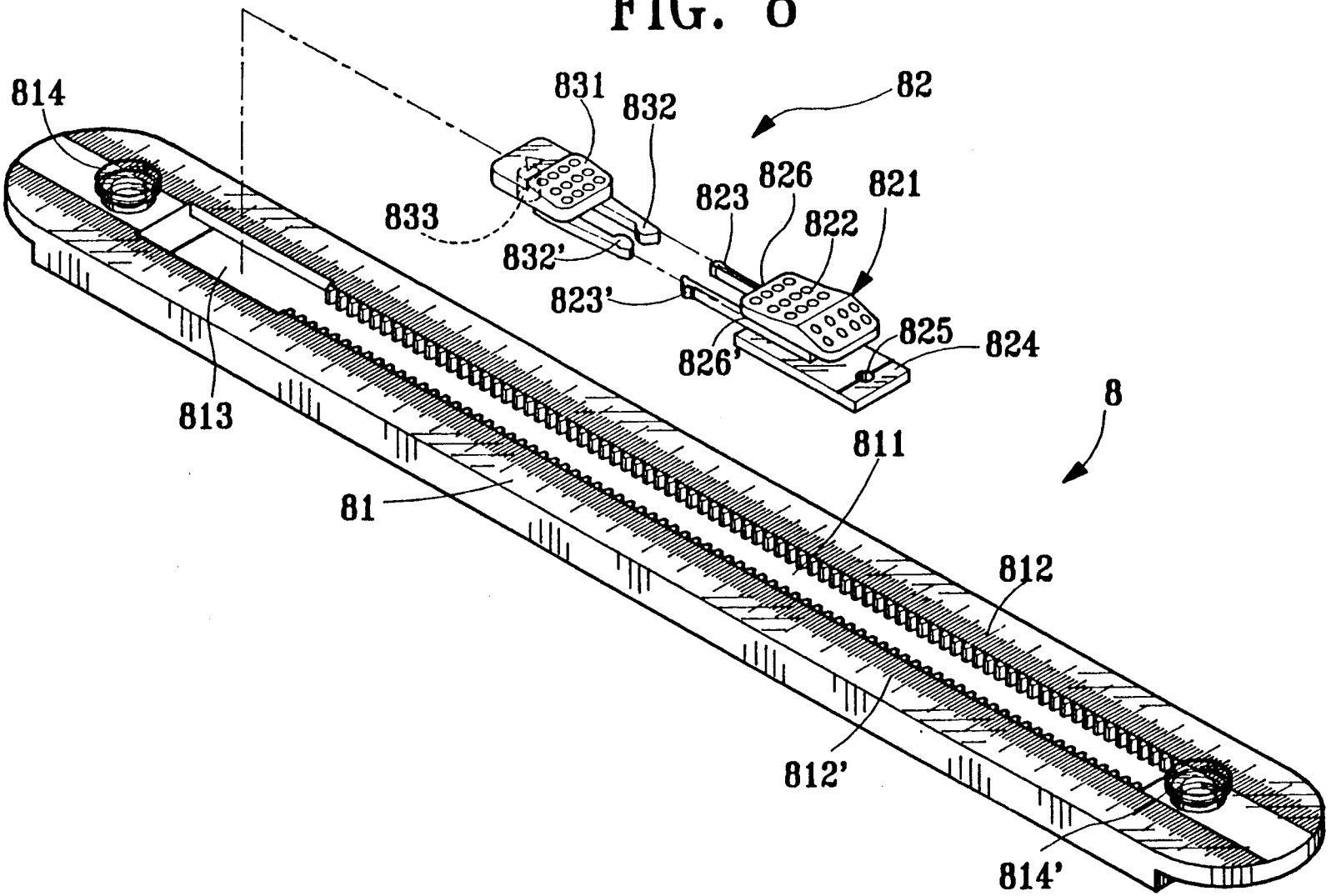
FIG. 8 is a perspective and fragmental view of the compass.
Figure 9A:
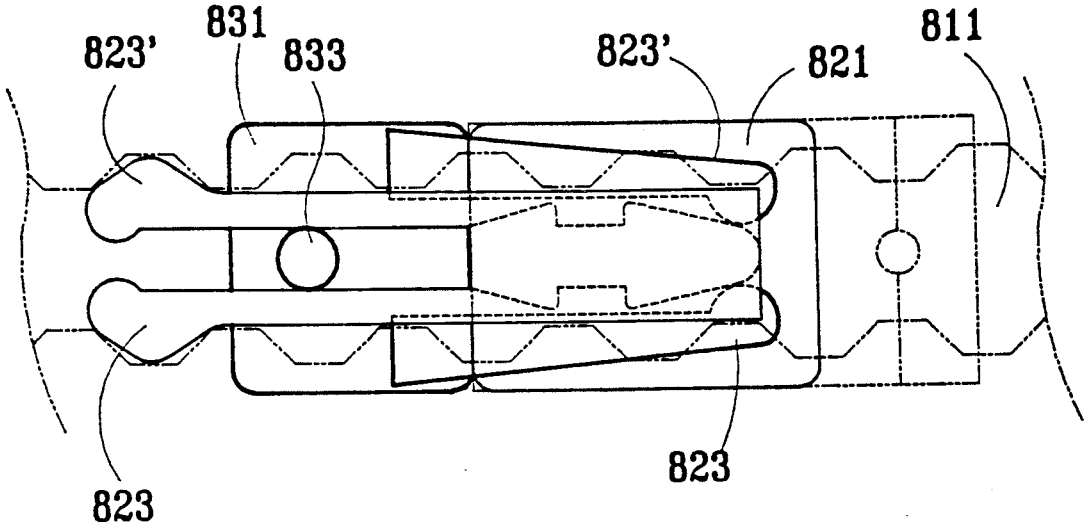
FIGS. 9A and 9B illustrates operation of the selection key for the compass according to the present invention.
Figure 9B:
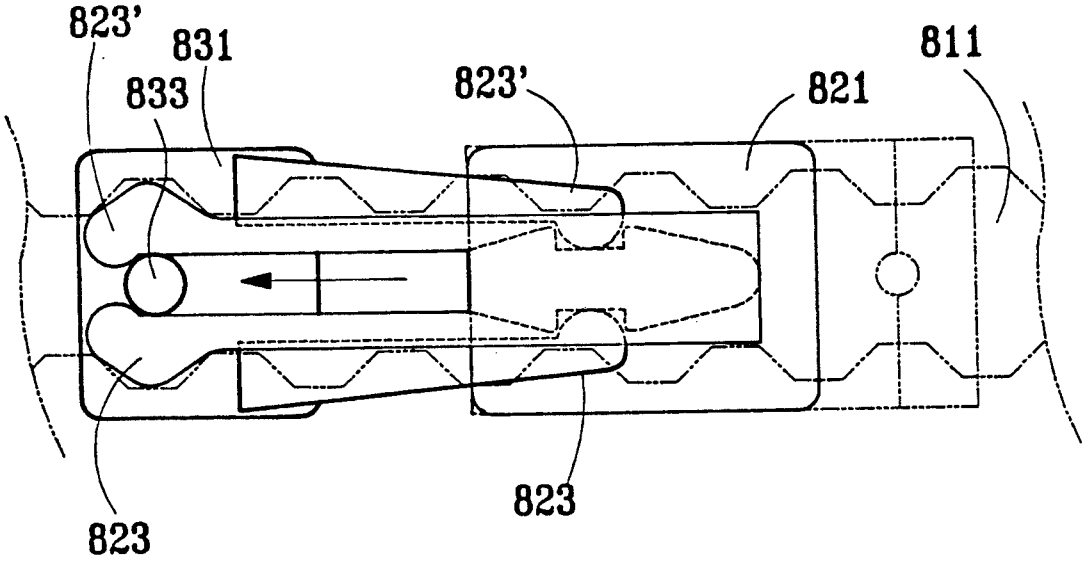

Reference will now be made to FIG. 8 in describing a perspective and fragmental view of a compass used for the present invention. The compass (8) comprise a body (81) and a selection key (82). The body (81) has a longitudinal toothed slot (811) along its central line, with corresponding scales (812 and 812') along both sides of the toothed slot (811). An extended slot (813) is formed at an end of the toothed slot (811) to provide a space for installation and removal of the selection key (82). The body (81) is an U channel structure to facilitate smooth sliding of the selection key (82) along the toothed slot (811) without any adverse effect to drawing of circles. A pivot (814) is formed at an end of the body (81), and another (814') at another end of the body (81). These pivots (814 and 814') are freely rotatable on the ruler body (81). The selection key (82) is composed of a push button (821) and a positioning button (831). A drive block (822) is designed on the push button (821) to facilitate pushing. Two seizing arms (823 and 823') are extended from the front end of the push button (821) and a sliding block (824) is fixed to the bottom of the push button (821). After the push button is engaged in the toothed slot (811) and slid beneath the ruler body (81), the seizing arms (823 and 823') can be seized at the toothed slot (811) to fix the extent of displacement. There is a hole (825) at the rear end of the sliding block (824) corresponding to the scales (812 and 812'). The positioning button (831) has two positioning arms (832 and 832') each with a hook tip corresponding to the push button (821) for insertion into respective slipways (826 and 826') at both lateral sides of the push button (821) so that the positioning arms (832 and 832') can be positioned in either a front or a back position in the slipways (826 and 826'). A stop block (833) is fixed to the bottom of the positioning button (831) and, following the displacement of the positioning button (831), provide for front and back displacements between the seizing arms (823 and 823') of the push button (821) as shown in FIG. 9A. When the push button (821) and the positioning button (831) located in the toothed slot (811) are fixed together, because the stop block (833) has been displaced to the root portion between the seizing arms (823 and 823'), by pushing of the drive block (822) manually, the selection key (82) can be freely displaced along the toothed slot (811) due to the flexibility of the seizing arms (823 and 823'). As shown in FIG. 9B, after the positioning button (831) has been displaced for a certain distance so that it has been separated from the push button (821), because the stop block (833) is just located between the seizing arms (823 and 823'), further application of force to the drive block can not cause the seizing arms (823 and 823') to rebound with their flexibility, and hence the selection key (82) is firmly positioned.

Figure 10:
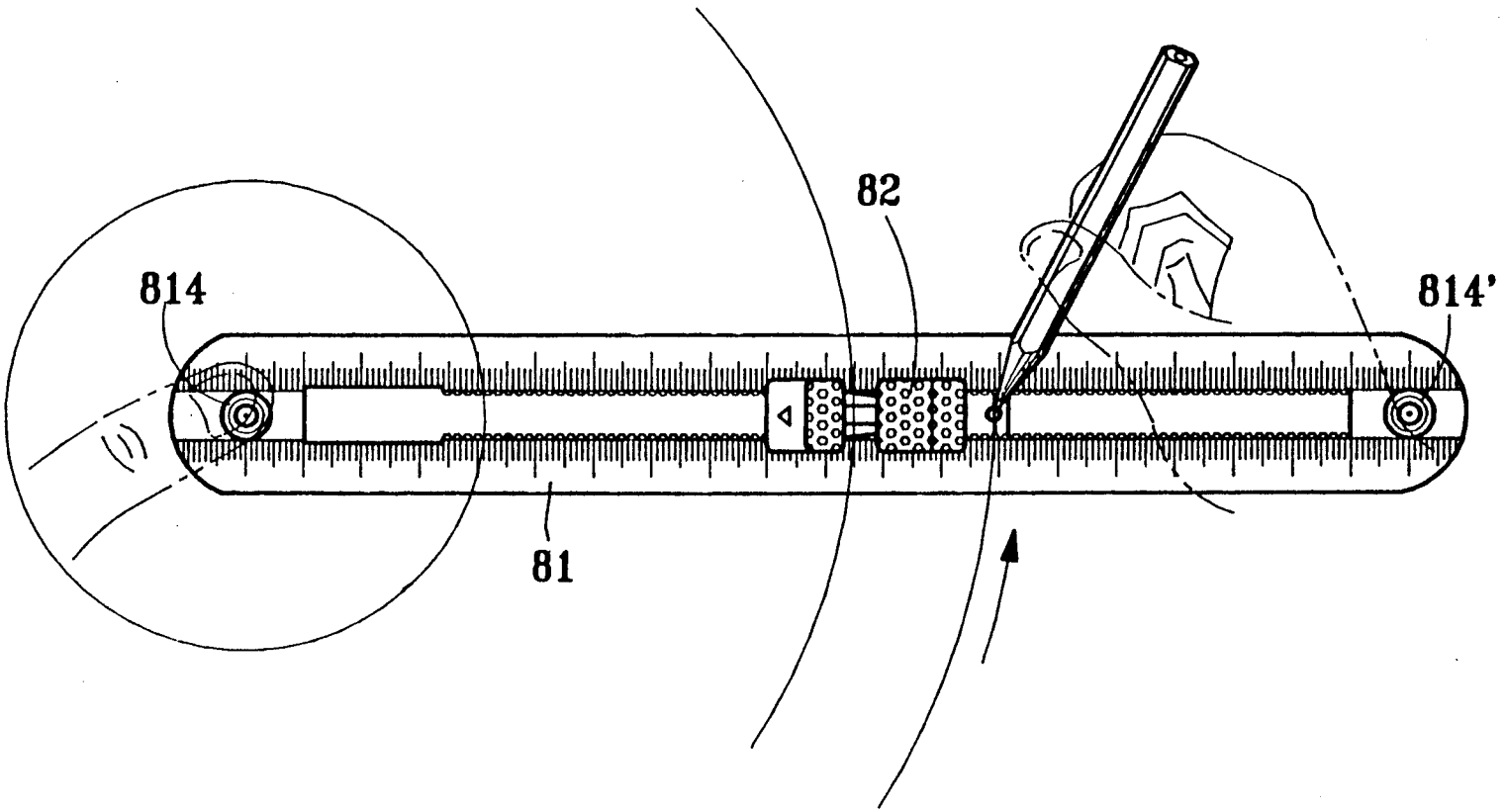
FIG. 10 illustrates drawing of a circle with the compass according to the present invention.

The above structure is designed to permit selection key (82) to be positioned at any location within the toothed slot (811) when the drawing ruler is used with the compass so that a pivot (814) will be defined for a center of a circle and a drawing pen can be inserted into the hole (825) for drawing of a circle by moving the body (81). Since the position of the selection key (82) can be changed within the toothed slot (811), the maximum radius of circle which the compass can draw is almost equal to the length of the body (81), as shown in FIG. 10, and then the radius of circle drawn can be maximized.

As described above, the present invention provides a multi-purpose drawing ruler which can perform the functions of different drawing tools for drawings of different graphs. It can be used in combination with different drawing templates, and it has braking, resetting and other functions to eliminate the defects of the prior art.

Many changes and modifications in the above described preferred embodiment of the invention can, of course, be carried out without departing from the scope hereof. Accordingly, to promote the progress in science and the useful arts, the invention is disclosed and is intended to be limited only by the scope of the appended claims.

What is claimed is:

1. A multi-purpose drawing ruler comprising:

a ruler body in the form of a rectangular board having a straight edge with markings of length, a plurality of through holes at appropriate positions along the markings for passing through of a drawing pen, a knob at the left end of the markings and another knob at its right end, a rail along the front edge of the ruler body, a slot for placing of a direction wheel shaft assembly in a middle portion of the ruler body, a pair of rails and an elliptic hole formed in the body at a side of the slot, another pair of rails and another elliptic hole formed at the opposite side, and a reset indicator on the top of each of the opposite sides of the slot;

first and second brake assemblies each composed of a sliding element and a spring with a round hole in the middle of each sliding element and a bore formed in a side of each sliding element for placing of the spring, said sliding elements being adapted to be inserted between a respective pair of rails;

a direction wheel shaft assembly including a shaft having a roller at each end of the shaft, a scale around each roller, and a screw hole at the center of each roller; and two reset shafts each passing through a respective elliptic hole of said ruler body and a respective hole of an associated brake assembly and then being fixed in a respective one of said screw holes of said direction wheel shaft assembly;

whereby the rollers of said direction wheel shaft assembly of said ruler body can freely roll upon a piece of drawing paper placed beneath said ruler body if the pressure applied to the ruler body is smaller than the tension of the springs in the brake assemblies which bias the rollers of the direction wheel shaft assembly outside the ruler body and then the ruler body can also be slid linearly on the drawing paper, and when the brakes are applied by exerting a pressure to the ruler body which is greater than the tension of the springs in the brake assemblies, the rollers retract into the ruler body thereby causing the ruler body to contact the drawing paper so as to prevent free rotation of the rollers and whereby the direction wheel shaft can be reset by turning the respective reset shafts so that the corresponding scale of the associated roller is aligned with its corresponding reset indicator on the ruler body.

2. A multi-purpose drawing ruler as claimed in claim 1, further including a retainer carried by the left side of the rail on the ruler body and another retainer carried by the right side of the rail whereby a drawing template may be attached to the ruler body by the retainers.

3. A multi-purpose drawing ruler as claimed in claim 2, wherein each retainer comprises a retainer body and a butterfly screw, a groove on the bottom of each retainer body for receiving the rail on the ruler body, and a screw hole adapted to threadably receive the butterfly screw such that a template can be secured to the ruler body between the ruler body and the butterfly screw.

4. A multi-purpose drawing ruler as claimed in claim 3, further comprising a compass composed of a body having a longitudinal toothed slot along its central line with corresponding scales along both sides of the toothed slot, an extended slot at an end of the toothed slot, a pivot freely rotatable at each end oft he body, and a selection key adapted to be selectively positioned within said toothed slot through said extended slot, said compass being removably attached to said ruler body through at least one of said retainers.

5. A multi-purpose drawing ruler as claimed in claim 4, wherein the selection key is composed of a push button and a positioning button, a drive block is carried by the push button, two seizing arms extend from a front end of the push button and a sliding bock is fixed to the bottom of the push button so that after the push button is engaged in the toothed slot through the extended slot and slid beneath the ruler body, the seizing arms can be seized in the toothed slot to fix the selection key in a desired position along the length of the toothed slot, a hole formed in the sliding block is adapted to be aligned with scales provided along the length of said toothed slot, the positioning button including two positioning arms each with a hook tip adapted to be inserted within respective slipways located at both lateral sides of the push button so that the positioning arms can be positioned in either a front or a back position in the slipways, and a stop block fixed to a bottom of the positioning button and adapted to be engaged by the seizing arms to limit the movements thereof.

* * * * *